United States Patent [19]

Pomponio, Sr.

[11] Patent Number: 4,493,349

[45] Date of Patent: Jan. 15, 1985

[54] LIQUID FILLING MACHINE

[75] Inventor: Daniel P. Pomponio, Sr., Cherry Hill, N.J.

[73] Assignee: Precision Automation Co., Inc., Cherry Hill, N.J.

[21] Appl. No.: 473,779

[22] Filed: Mar. 10, 1983

[51] Int. Cl.[3] ..... B65B 31/04

[52] U.S. Cl. ..... 141/59; 141/286; 141/301; 137/246.22

[58] Field of Search ..... 141/1-12, 141/37-70, 250-284, 285-310, 392, 85-92; 137/246.22

[56] References Cited

U.S. PATENT DOCUMENTS

| | | | |
|---|---|---|---|
| 2,611,576 | 9/1952 | Storment | 137/246.22 |
| 3,270,766 | 9/1966 | Stone | 137/246.22 |
| 4,103,721 | 8/1978 | Noguchi | 141/90 |

*Primary Examiner*—Houston S. Bell, Jr.
*Attorney, Agent, or Firm*—Robert K. Youtie

[57] ABSTRACT

A machine for filling liquid into flexible or rigid containers, including a filling head for passing fill liquid to a container, a valve in the head, an outlet from the head to the container, and a vacuum source connected to the head for evacuating the container prior to filling.

4 Claims, 4 Drawing Figures

FIG. 1
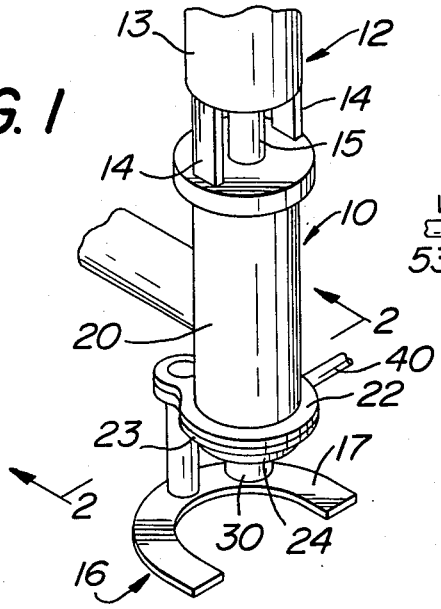
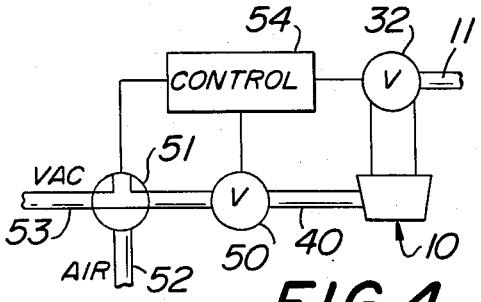
FIG. 4
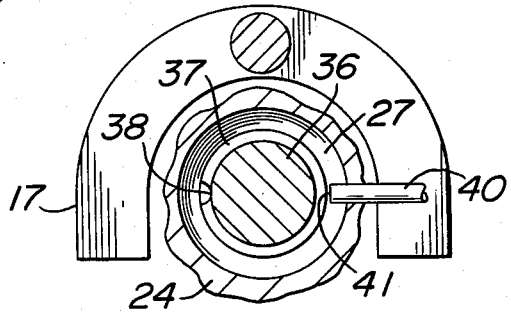
FIG. 3
FIG. 2
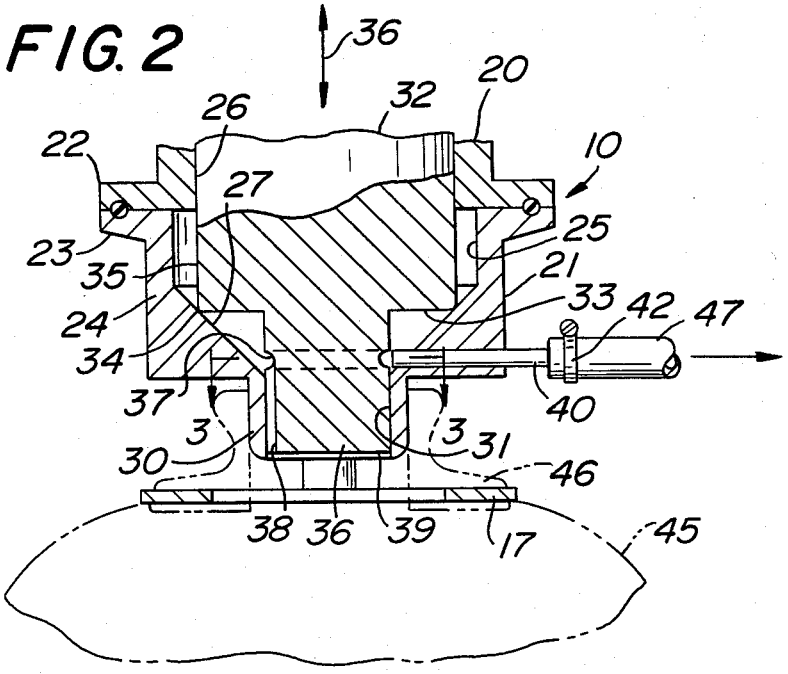

LIQUID FILLING MACHINE

BACKGROUND OF THE INVENTION

While there have, in the past, been a wide variety of liquid filling machines, as for filling flexible containers or bags, a problem has existed in satisfactorily removing air from the containers prior to filling, the contained air being undesirable for many reasons, including possible contamination and shortage of contents.

SUMMARY OF THE INVENTION

Accordingly, it is an important object of the present invention to provide a liquid filling machine wherein air is automatically evacuated from a container before the liquid fill material is introduced, the machine being highly automatic in operation and entirely reliable throughout a long useful life.

It is a further object of the present invention to provide a liquid filling apparatus of the type described wherein a vacuum line communicates through a filling head to a flexible container for evacuating the latter prior to opening of the filling head to pass liquid fill into the container.

It is another object of the present invention to provide apparatus of the type mentioned in the preceding paragraph, wherein there is provided means for purging the vacuum line prior to the application of vacuum.

It is still another object of the present invention to provide apparatus of the type described wherein a vacuum line connects to a filling head by a unique structure which effectively eliminates or minimizes the possibility of fill material contaminating the vacuum system.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a filling head constructed in accordance with the teachings of the present invention.

FIG. 2 is a partial sectional elevational view taken generally along the line 2—2 of FIG. 1.

FIG. 3 is a horizontal sectional view taken generally along the line 3—3 of FIG. 2.

FIG. 4 is a diagrammatic representation of the filling system including the filling head operating components and controls.

DESCRIPTION OF THE PREFERRED EMBODIMENT

Referring now more particularly to the drawings, and specifically to FIG. 1 thereof, a filling head is there generally designated 10, including a fill conduit 11 communicating with the interior of the filling head, and an operator 12, which may include a cylinder-and-piston assembly 13 superposed on the head 10, as by mounts 14, and the piston rod 15 extending from the operator assembly 12 into the filling head for operating the latter. In addition, a container holder 16 may be provided for removably holding a container, such as a flexible bag, in hermetic communication with the head 10. The container holder 16 may include an open jaw 17 for interengagement with the neck or opening of a container, and suitable actuating means may be provided for moving the jaw into and out of container sealing relation with the head 10. The container holder and its actuating means may be conventional.

Referring now to FIGS. 2 and 3, the filling head 10 may include an elongate chamber or cylinder 20 illustrated as generally upright and provided on its lower end with an outlet fitting 21. The lower end of the cylinder 20 may be provided with a circumferential flange 22, and the fitting 20 may be generally cylindrical and provided on its upper end with a flange 23 suitably secured in sealing engagement with the cylinder flange 22.

The fitting 21 includes a generally cylindrical intermediate portion 24 depending from the flange 23 coaxially with the cylinder 20 and having internal cylindrical surface or wall 25 coaxially with and of a diameter greater than the internal cylindrical surface or wall 26 of the cylinder 20. The internal cylindrical wall 26 of the fitting 21 intersects at its lower end with a downwardly convergent, internally conical surface 27. A depending outlet tube or nipple 30 projects from the lower end of the intermediate fitting portion 21, and is formed internally with a cylindrical surface 31 concentric with and considerably reduced relative to the diameter of internal cylindrical surface 25. Thus, the internal, reduced cylindrical surface 31, which intersects with the lower, smaller diameter end of internal conical surface 27, has its lower end open to provide an outlet defined by the nipple 30.

As will appear presently, the lower end fitting 21 defines a valve body, and internally thereof is a piston 32 slidable in the cylinder 20 and defining a valve member or element cooperative with the valve body 21. More specifically, the valve element or piston 32 may be slidable in the cylinder 20, having an external diameter less than the internal diameter of the valve body wall 25, and terminating in an end surface 33 defining a generally circular intersection 34 with the side wall 35 of the piston 32.

The piston or valve element 32 is vertically reciprocable, as indicated by the arrows 36, and movable into and out of its closed position of FIG. 2 with the circumferential edge 34 in sealing peripheral engagement with the internal conical surface 27. In practice, the valve body 21 may be formed of metal, say of stainless steel, and the valve element or piston 32 may be formed of suitable plastic, for effective sealing when closed, as well as sanitation.

Centrally of the piston 32, projecting from the lower end 33 may be a reduced extension or pilot 36, concentric with the body of piston 32 and sized for guiding engagement in the outlet 31 of nipple 30. The reduced extension 36 defines a pilot for assuring proper sealing relation between the valve element or piston 32 and the valve seat 27.

The extension or pilot 36 is circumferentially formed with a groove or recessed formation 37 positioned so as to be located inward of the nipple 30 when the pilot is fully extended into the nipple. Thus, the groove 37 extends about the pilot 36 within the conical valve seat 27 in the closed position of the valve element. In addition, a recess, groove or flat 38 is formed on the pilot 36 extending longitudinally thereof from the groove 37 to the end surface 39. Thus, the recessed formations 37 and 38 communicate, when the valve member 32 is closed, from the interior of the valve body 21, outwardly through the nipple 30, to the exterior of the valve body.

A conduit, or cylindrical tube 40 extends radially inwardly through the intermediate valve body portion 21 and terminates internally of the valve body in the generally square end 41 located proximate to and generally aligned with the groove 37 when the valve member 32 is closed. That is, the cylindrical tubular member or conduit 40 extends inwardly into the interior of the valve body 21, entering through the conical internal surface 27 at an elevation adjacent to and slightly above the lower end of the conical surface, at the intersection of the conical surface with the internal cylindrical surface 31 of the nipple 30. The inner end 41 of the cylindrical tube 40 extends radially inwardly and terminates in a plane just outward beyond a tangent to the internal nipple surface 31, which plane is generally parallel to the axis of the piston 32 and conical surface 27.

The conduit 40 may further include additional tubular material, such as hose material 47, connected by a suitable clamp 42 to the cylindrical tube 40.

A container is shown in phantom at 45, such as a plastic bag, having a suitable mouth 46 engaged by the jaw 17 to hold the mouth piece 46 in sealed relation with the nipple 30 for hermetic communication between the interior of container 45 and the interior of fitting 21.

In the system diagram of FIG. 4, the fill head is illustrated at 10, and the fill valve element shown at 32. The fill line or conduit 11 communicates from a reservoir of fill liquid to the fill valve 32.

The conduit 40 communicates from the fill head 10, through an on-off valve 50 to a three way valve 51, which in turn communicates through a conduit 52 to a source of pressure or air, and through a conduit 53 to a source of vacuum. Suitable control means are designated 54 to effect operation of the valves in the desired relationship.

OPERATION

With the fill valve member 32 closed, a container 45 is engaged in sealed relation with the outlet nipple 30. The valve 50 is opened, and the valve 51 communicates the valve 50 to the vacuum source for evacuating the container 45. When the container 45 is suitably evacuated, say to a predetermined vacuum, the control means closes valve 50 and opens valve 32. That is, the valve element 32 is raised to communicate fill conduit 11 with interior of cylinder 20, for passage downwardly through valve body 21 and nipple 30 to the interior of container 45. The fill liquid, by physical laws, increases in speed upon passage through the conical chamber 27; and, this high speed flow passes over and away from the inner end 41 of conduit tube 40. By this structure the fill liquid passes away from the internal end 41 of the conduit 40, so that little or none of the fill liquid enters into the conduit 40.

Upon proper metering of a desired quantity of fill liquid into the container 45, the fill valve 32 is closed, and the container may be removed.

Following removal of the container 45, and before replacement by an empty container, a purge cycle occurs, which consists in operation of valve 51 by control means 54 to communicate pressurized fluid or air through conduit 52 with valve 50, which opens to clear the conduit 40 of any fill material which may possibly have entered the latter conduit. The above described cycle may then be repeated.

It will now be understood that, as the conduit 40 is connected to the valve body or fitting 21 at a location downstream of the valve element 32, with regard to the flow direction of fill liquid, that evacuation of fluid will occur from the container 45 and from the fitting 21 up to the sealing edge 34 of the valve element. The container is then filled with fill liquid to assure full desired quantity in the container, and that contents of the container are not contaminated by any trapped air.

From the foregoing, it is seen that the present invention provides a liquid filling machine of the type described which is extremely simple in construction, highly automatic in operation, and fully accomplishes its intended objects.

Although the present invention has been described in some detail by way of illustration and example for purposes of clarity of understanding, it is understood that certain changes and modifications may be made within the spirit of the invention.

What is claimed is:

1. In a liquid filling machine, the combination comprising: a filling head for passing fill liquid to a container, a fill valve in said head for opening and closing said head to the passage to fill liquid, an outlet on said head downstream of said fill valve for hermetic communication with the container, a fluid conduit communicating with the interior of the filling head between said fill valve and outlet, and a vacuum source connected to said conduit for evacuating the container and filling head upstream to said fill valve prior to filling of the container, said filling head comprising an internally hollow member having an opening defining said outlet, said fill valve comprising a valve seat in said hollow member extending about said opening, and a valve member movable into and out of sealing engagement with said valve seat, said valve seat comprising a generally conical internal surface in said hollow member converging toward said opening for increasing the speed of fill liquid toward said opening, and said fluid conduit comprising a tubular member extending inwardly through and beyond said conical surface and terminating in an end surface lying in a plane generally longitudinally of the axis of said conical surface for effective protection of said end surface from fill liquid moving at increased speed and deflected by said tubular member away from said end surface.

2. The combination according to claim 1, in combination with a nipple externally on said hollow member and having an opening for connection to the container.

3. The combination according to claim 1, in combination with a pilot extension on said valve member for guiding engagement through said opening, and a recessed formation in said pilot extension for communicating said fluid conduit through said recessed formation to the interior of a container.

4. The combination according to claim 1, in combination with a pressure source connected to said conduit valve and conduit for purging the conduit of fill liquid prior to container evacuation, said control means operating to communicate said pressure source to said filling head after filling a container and before evacuating a subsequent container to effect said purging.

* * * * *